United States Patent [19]

Beckman et al.

[11] Patent Number: 4,908,890

[45] Date of Patent: Mar. 20, 1990

[54] MODIFIED TRANSFER BOARD

[76] Inventors: Wellington E. Beckman, 9802½ Dexter, Tampa, Fla. 33604; George Spector, 233 Broadway RM 3815, New York City, N.Y. 10007

[21] Appl. No.: 291,606

[22] Filed: Dec. 29, 1988

[51] Int. Cl.[4] ..... A61G 7/08

[52] U.S. Cl. ..... 5/81 R; 5/81 B

[58] Field of Search ..... 5/81 R, 81 B, 507; 108/1, 6, 90, 97; 297/188, 195, DIG. 4

[56] References Cited

U.S. PATENT DOCUMENTS

| | | | |
|---|---|---|---|
| 2,509,551 | 5/1950 | Woods | 5/81 R X |
| 3,052,894 | 9/1962 | Bigger | 5/81 R |
| 3,344,445 | 10/1967 | Crawford | 5/81 B X |
| 3,403,411 | 10/1968 | Steinemann et al. | 5/81 R |
| 3,891,268 | 6/1975 | Taylor | 297/DIG. 4 X |
| 4,155,588 | 5/1979 | Danziger et al. | 5/81 R X |
| 4,815,688 | 3/1989 | Wood | 297/194 X |

*Primary Examiner*—Michael F. Trettel

[57] ABSTRACT

A device is provided for transferring an invalid from a bed to a wheelchair that includes a transfer board which is connected by a retaining post to an upstanding frame portion of the wheelchair. The transfer board can pitch from side to side during transferring of the invalid.

5 Claims, 1 Drawing Sheet

MODIFIED TRANSFER BOARD

BACKGROUND OF THE INVENTION

The instant invention relates generally to apparatuses for moving disabled people and more specifically it relates to a device for transferring an invalid from a bed to a wheelchair.

Numerous apparatus for moving disabled people have been provided in prior art that are adapted to be of structures to support and transport the disabled people from one place to another. For example, U.S. Pat. Nos. 3,981,484; 4,733,903 and 4,737,997 all are illustrative of such prior art. While these units may be suitable for the particular purpose to which they address, they would not be as suitable for the purposes of the present invention as heretofore described.

SUMMARY OF THE INVENTION

A primary object of the present invention is to provide a device for transferring an invalid from a bed to a wheelchair that will overcome the shortcomings of the prior art devices.

Another object is to provide a device for transferring an invalid from a bed to a wheelchair that includes a transfer board that can be connected to a wheelchair allowing the transfer board to pitch from side to side during transfering the invalid.

An additional object is to provide a device for transferring an invalid from a bed to a wheelchair that includes a retaining post connected to the wheelchair which will prevent the transfer board from slipping while the invalid is transferring.

A further object is to provide a device for transferring an invalid from a bed to a wheelchair that is simple and easy to use.

A still further object is to provide a device for transferring an invalid from a bed to a wheelchair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 3:
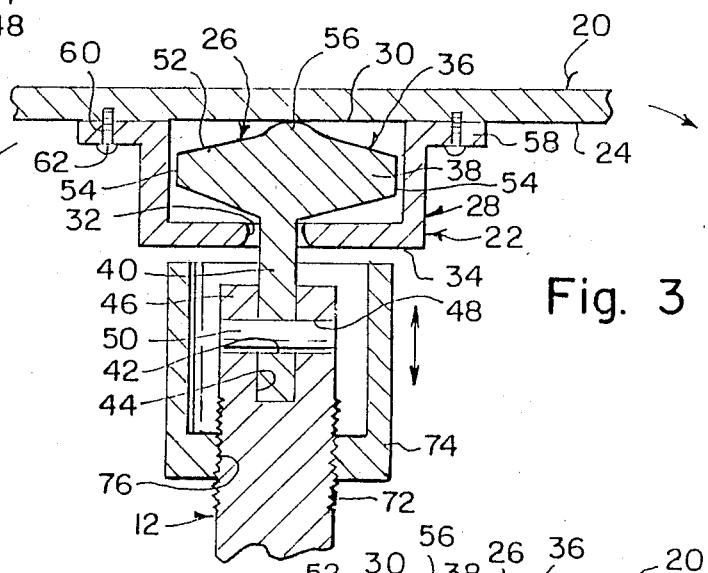

FIG. 3 cross sectional view of a modification in which an adjustment collar on the retaining post regulates side to side pitch of the transfer board.

Figure 4:
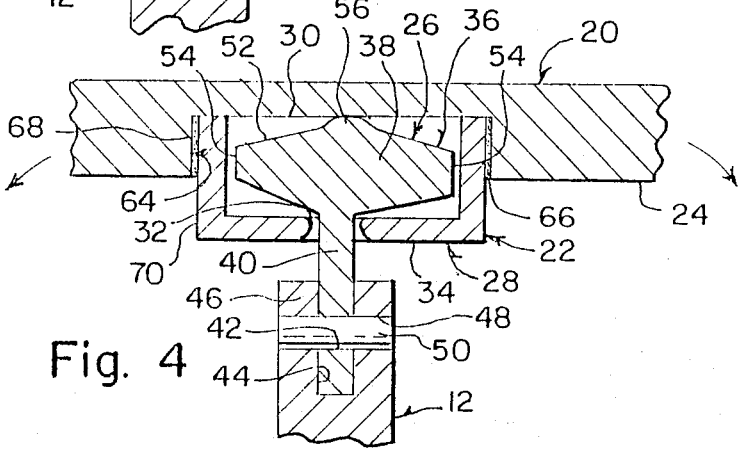

FIG. 4 is a cross sectional view of another modification in which the housing is secured into a central recess in underside of the transfer board.

DETAILED DESCRIPTION OF THE PREFERRED EMBODIMENTS

Figure 1:
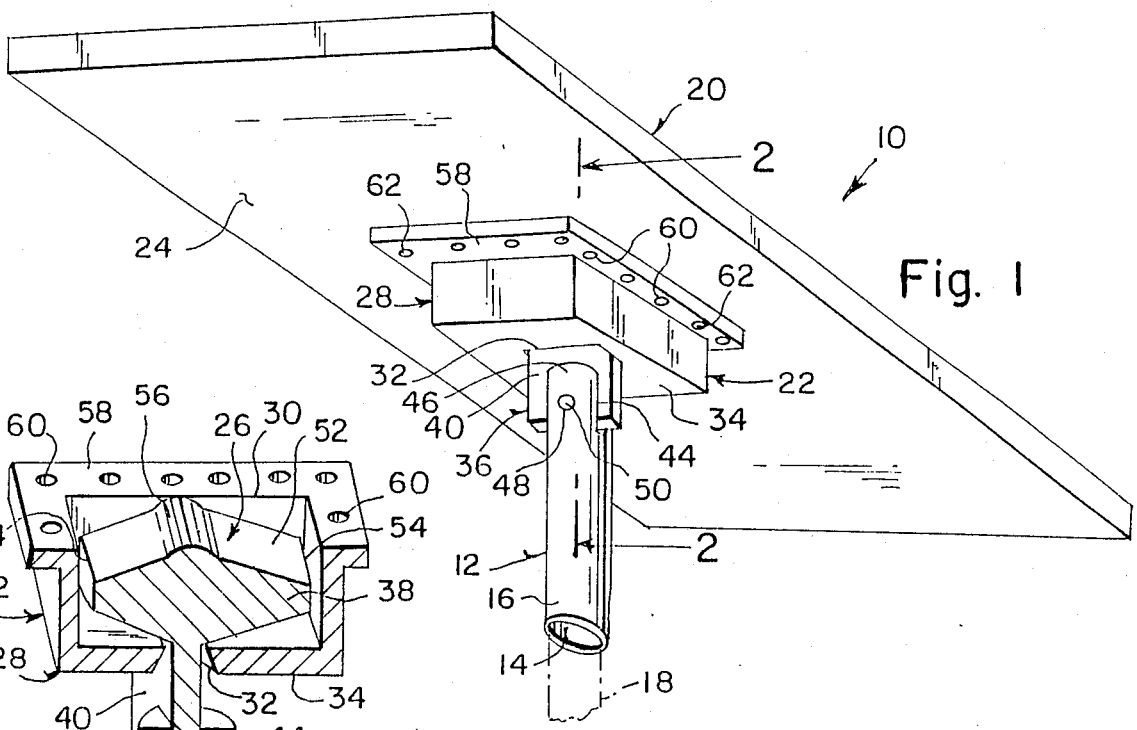
FIG. 1 is a perspective view of the invention.

Turning now descriptively to the drawings, in which similar reference characters denote similar elements throughout the several views, FIG. 1 illustrates a device 10 for transferring an invalid from a bed to a wheelchair consisting of a retaining post 12 that has a recess 14 at lower end 16 for receiving an upstanding frame portion 18 of the wheelchair, while a transfer board 20 is provided for supporting and carrying the invalid. A structure 22 is for centrally securing underside 24 of the transfer board 20 to the retaining post 12 so as to elevate the transfer board 20 above seat (not shown) of the wheelchair to facilitate the transferring of the invalid. Another structure 26, as shown in FIG. 2, within the securing structure 22 is for allowing the transfer board 20 to pitch from side to side during the transferring of the invalid from the bed to the wheelchair.

The securing structure 22 includes a hollow box-shaped housing 28 that has an open top 30 and an outwardly beveled slot 32 in bottom wall 34. The housing 28 is centrally secured to the underside 24 of the transfer board 20. A bracket 36 is provided which includes a head portion 38 and a leg portion 40 that has a transverse hole 42 therethrough. The head portion 38 fits within the housing 28 so that the leg portion 40 will extend downwardly from the beveled slot 32. The retaining post 12 has a slot 44 through upper end 46 and a transverse aperture 48 to intersect the slot 44 so that the leg portion 40 can enter the slot 44 with the hole 42 in alignment with the aperture 48. A pin 50 extends through the aperture 48 in the retaining post 12 and the hole 42 in the leg portion 40 so as to secure the transfer board to the retaining post 12.

The pitch structure 26 consists of the head portion 38 of the bracket 36 being in cross section diamond shaped 52 with truncated ends 54 and has a rounded top 56 at apex thereof to allow the transfer board 20 to pitch, approximately to 10 degrees, from side to side.

Figure 2:
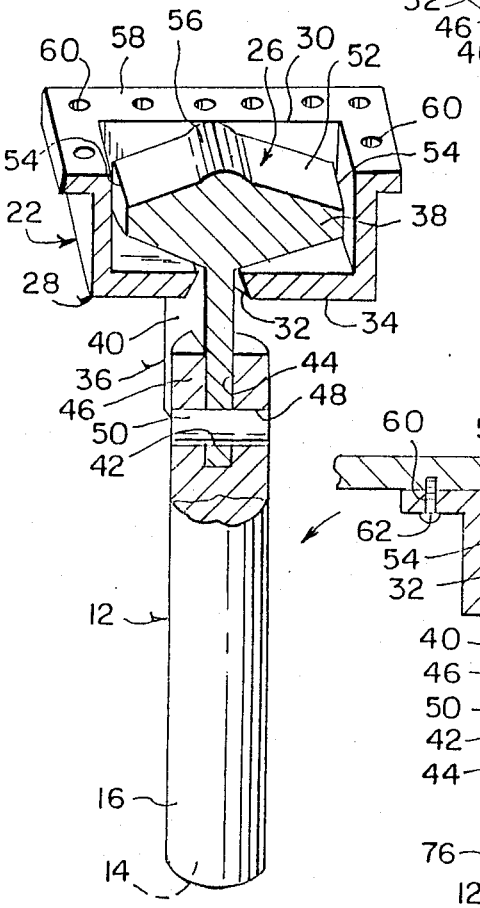
FIG. 2 is a perspective cross sectional view taken along line 2—2 in FIG. 1, showing the housing, bracket and retaining in greater detail.

As shown in FIGS. 1, 2 and 3, a flange 58 is formed about the open top 30 of the housing 28 and has a plurality of holes 60 therein. A plurality of fasteners 62, such as bolts or the like, are provided wherein each extends through one of the flange holes 60 and into underside 24 of the transfer board 20.

As shown in FIG. 4, the transfer board 20 has a box-shaped recess 64 centrally located at underside 24 thereof so as to allow the housing 28 to fit therein. Adhesive material 66 fits between side walls 68 of the recess 64 and side walls 70 of the housing 28 for securing the housing within the recess 64.

As shown in FIG. 3, the retaining post 12 has external threads 72 thereon located at upper end 46 below the pin 50. An adjustment collar 74 is provided and has an internally threaded aperture 76 so that the collar 74 can threadably fit onto the retaining post 12 to regulate the side to side pitch of the transfer board 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for transferring an invalid from a bed to a wheelchair with a seat comprising:

(a) a retaining post having a lower and upper end and a recess at said lower end for receiving an upstanding frame portion of the wheelchair;

(b) a transfer board with an underside for supporting and carrying the invalid;

(c) means for centrally securing said underside of said transfer board to said retaining post so as to elevate said transfer board above said seat of the wheelchair to facilitate the transferring of the invalid;

(d) means within said securing means for allowing said transfer board to pitch from side to side during the transferring of the invalid from the bed to the wheelchair, wherein said securing means includes:

(e) a hollow box-shaped housing with a bottom wall and an open top and an outwardly beveled slot in bottom wall, said housing centrally secured to the underside of said transfer board;

(f) a bracket which includes a head portion and a leg portion having a transverse hole therethrough said head portion fits within said housing so that said leg portion will extend downwardly from said beveled slot;

(g) said retaining post having a slot through said upper end and a transverse aperture to intersect said slot so that said leg portion can enter said slot with said hole in alignment with said aperture; and (h) a pin to extend through said aperture in said retaining post and said hole in said leg portion as to secure said transfer board to said retaining post.

2. A device as recited in claim 1 wherein said pitch means comprises said head portion of said bracket being in cross section diamond shaped with truncated ends and an apex with a rounded top to allow said transfer board to pitch from side to side.

3. A device as recited in claim 2, further comprising:

(i) a flange formed about said open top of said housing said flange having a plurality of holes therein and;

(j) a plurality of fasteners, each extending through one of said flange holes and into the underside of said transfer board.

4. A device as recited in claim 2, further comprising:

(k) said transfer board having a box-shaped recess centrally located at the underside thereof so as to allow said housing to fit therein;

(l) adhesive material to fit between side walls of said recess and side walls of said housing for securing said housing within said recess.

5. A device as recited in claim 2, further comprising:

(m) said retaining post having external threads thereon located at said upper end below said pin and (n) an adjustment collar having an internally threaded aperture so that said collar can threadably mounted onto said retaining post adjacent said bottom wall of said housing to regulate the side to side pitch of said transfer board, by engaging said housing at a predetermined transfer board pitch.

* * * * *

UNITED STATES PATENT AND TRADEMARK OFFICE

CERTIFICATE OF CORRECTION

PATENT NO. : 4,908,890

DATED : March 20, 1990

INVENTOR(S) : Beckman et al

It is certified that error appears in the above-identified patent and that said Letters Patent is hereby corrected as shown below:

On the title page, item [76] Inventors: in the first inventor's address please change "9802½" to read --8920½--.

Signed and Sealed this

Fifth Day of May, 1992

*Attest:*

DOUGLAS B. COMER

*Attesting Officer*

*Acting Commissioner of Patents and Trademarks*